US006158622A

United States Patent [19]

Igarashi

[11] Patent Number: 6,158,622

[45] Date of Patent: Dec. 12, 2000

[54] CLOSURE TO BE ATTACHED TO A CONTAINER

[75] Inventor: Masao Igarashi, Ageo, Japan

[73] Assignee: Nihon Kim Co., Ltd., Japan

[21] Appl. No.: 09/247,150

[22] Filed: Feb. 9, 1999

[30] Foreign Application Priority Data

Feb. 12, 1998 [JP] Japan ..... 10-029637
Apr. 30, 1998 [JP] Japan ..... 10-120806

[51] Int. Cl.[7] ..... B65D 35/08

[52] U.S. Cl. ..... 222/107; 222/541.5; 222/549.9

[58] Field of Search ..... 222/92, 107, 541.5, 222/549.9

[56] References Cited

U.S. PATENT DOCUMENTS

| | | | |
|---|---|---|---|
| 2,750,068 | 6/1956 | Platt | 222/541.5 |
| 3,986,646 | 10/1976 | Strub | 222/529 |
| 5,636,771 | 6/1997 | Gordon et al. | 222/541.5 |
| 5,699,936 | 12/1997 | Sakamoto | 222/107 |
| 5,911,340 | 6/1999 | Uematsu | 222/92 |

FOREIGN PATENT DOCUMENTS

| | | |
|---|---|---|
| 50-136618 | 4/1949 | Japan . |
| 61-117121 | 7/1986 | Japan . |
| 2-21399 | 6/1990 | Japan . |
| 3-26751 | 3/1991 | Japan . |
| 4-32949 | 3/1992 | Japan . |
| 4-56623 | 5/1992 | Japan . |
| 5-44294 | 11/1993 | Japan . |

*Primary Examiner*—Kevin Shaver
*Assistant Examiner*—Melvin Cartagena
*Attorney, Agent, or Firm*—Harness, Dickey & Pierce, P.L.C.

[57] ABSTRACT

A closure to be attached to a container, comprises a spout section through which contents of the container pass, a closure main body connected to the spout section with a thin-thickness connecting section interposed therebetween, a projection to be fitted into the spout section such that it tightly contacts an inner peripheral surface portion of the spout section, and a sealing wall for preventing leakage of the contents, and a pinch section coupled to the closure main body. Cutouts are formed in the closure main body above the thin-thickness section, thereby providing coupling sections which couple the pinch section side to the thin-thickness section side.

15 Claims, 10 Drawing Sheets

CLOSURE TO BE ATTACHED TO A CONTAINER

BACKGROUND OF THE INVENTION

This invention relates to a closure to be attached to a container for containing a fluid such as a liquid food, seasoning, detergent, etc. (hereinafter referred to as "contents").

A conventional container for containing contents as above is provided in the form of, for example, a plastic bottle or by, for example, fusion of soft synthetic resin sheets, and has a closure of a synthetic resin through which the contents come out. This closure has a function of sealing the contents in the container when they are being sold, and re-sealing the container after it is once opened.

The re-sealing function of the conventional closure is realized by a structure which consists of a plurality of closure members (a so-called two-piece structure is well known). In a case where such a two-piece closure is attached to a plastic bottle, it comprises a main body to be attached to the opening of the bottle, and a cap which can be attached to and detached from the main body. The main body has a closing section of a thin thickness provided with a score line and disposed to close the opening of the bottle. The closing section is provided with a pinch section which facilitates ripping of the closing section along the score line. The bottle opening is opened along the score line by pinching the pinch section and ripping the closing section along the line. After the contents are taken out of it, the bottle is again sealed by attaching the cap to the main body of the closure.

The conventional closure with the re-sealing function has the aforementioned two-piece structure and is therefore inevitably expensive. Moreover, since the opening is formed by ripping the closing section of the main body along the score line provided therein, there exists a space between the opening and the cap, into which the liquid may easily leak or drip. This is inconvenient during use.

To avoid it, it is considered to impart to the closure a one-piece structure in which those structural members are formed integral with each other as one body. However, it is difficult to construct the closure such that the main body and the cap can be easily and reliably separated from each other during use, and be reliably coupled to each other in a liquid-tight manner.

In other words, if both the main body and the cap cannot be separated unless a strong force is applied thereto, or if they are separated at inappropriate portions thereof when the user has handled the closure in an optional manner, the closure will be hard for the user to handle.

BRIEF SUMMARY OF THE INVENTION

It is the object of the invention to provide a closure which is to be attached to a plastic bottle or a container formed of, for example, soft synthetic resin sheets, has a function for reliably re-sealing the bottle or container in a simple manner at low cost, and can be easily handled.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
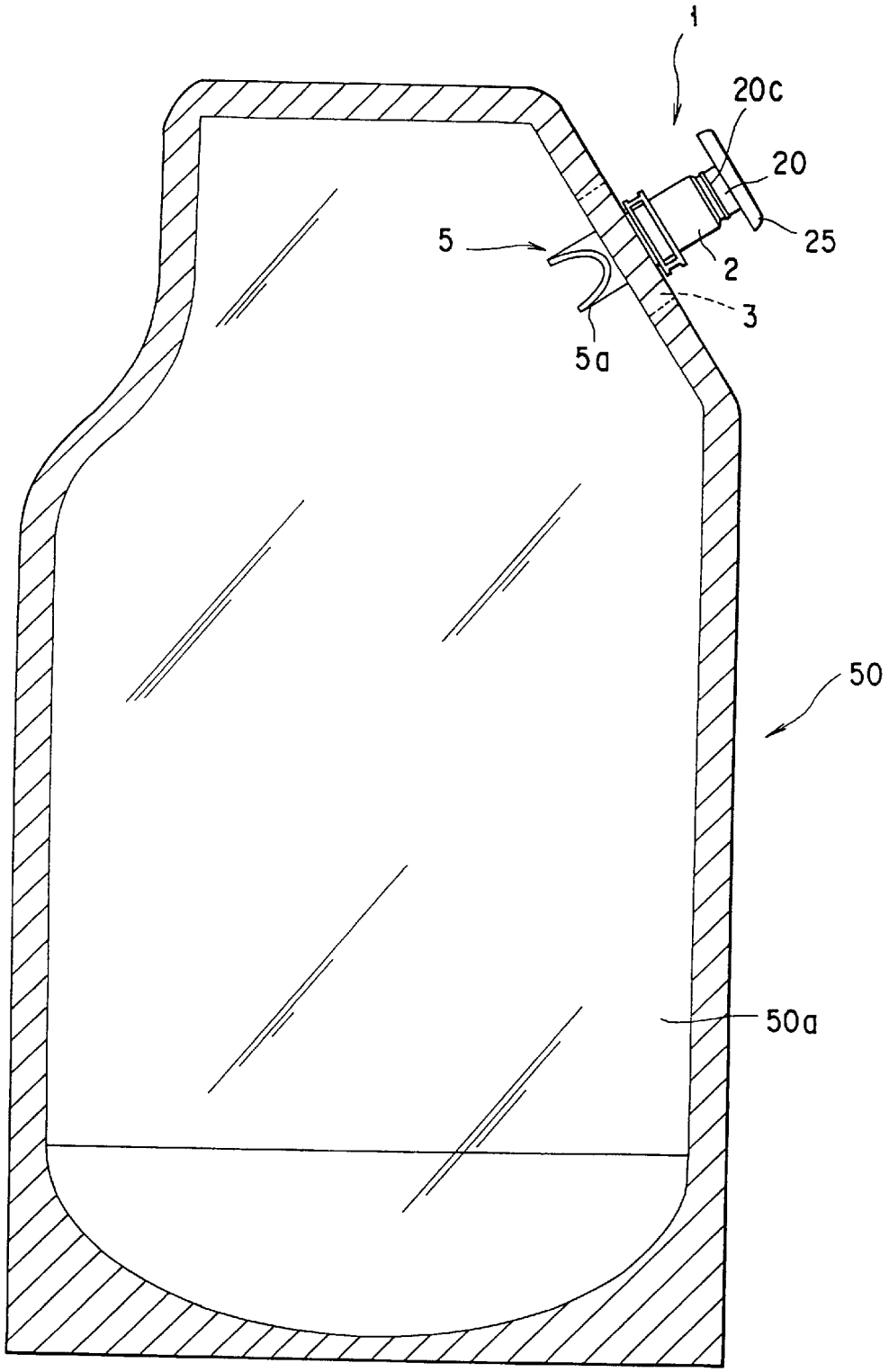
FIG. 1 is a view of a closure according to a first embodiment of the invention, showing a state in which the closure is attached to a container formed of synthetic resin sheets.

FIGS. 1, 2A to 2C show a first embodiment of the invention. As is shown in FIG. 1, a closure 1 is designed to be attached to, for example, a refill container 50 sold separately from a main container, which contains food or detergent. The container 50 is formed by adhering, by fusion, a plurality of relatively cheap soft synthetic resin sheets 50*a*. In FIG. 1, the hatched portion is the area of adhesion by fusion.

The closure 1 comprises a main body section (spout section) 2 in which a communication hole section 2*a* for passing the contents therethrough is formed and a cylindrical closure main body 20 which is connected to the spout section 2 with a thin-thickness section 20*a* interposed therebetween. The closure main body 20 has a sealing wall 20*b* for preventing leakage of the contents. These sections are made of a synthetic resin such as polypropylene, polyethylene, etc. such that they are formed integral with each other as one body. The spout section 2 is adhered, by fusion, to an appropriate portion of the synthetic resin sheets 50*a* of the container 50 during the fusion process in which the sheets 50*a* are adhered to each other. A to-be-fused section 3 of a shape which enables easy adhesion of the closure to the synthetic resin sheets of the container and has, for example, a substantially elliptical or circular section forms an intermediate portion of the spout section 2. Although the spout section 2 has circular cross section, the portion of the spout section 2 through which the contents passes can be formed in various shapes such as an elliptical one, a rectangular one, etc.

The closure main body 20 is coupled, as one body, with the spout section 2 via the thin-thickness section 20*a*. The thin-thickness section 20*a* is used to keep the container in a contents-sealed state, and ripped to take the contents out of the container. To this end, it is desirable to set the thickness of the thin-thickness section 20*a* at about 0.1 mm–0.5 mm.

Figure 2A:
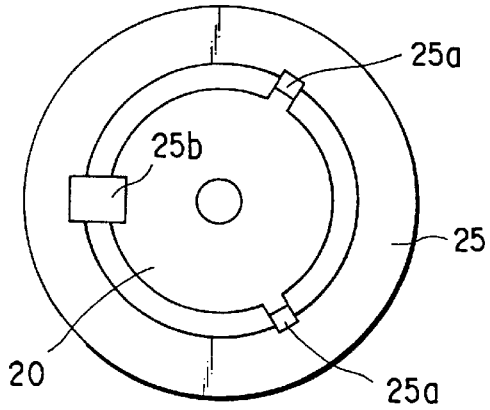
FIGS. 2A–2C show the closure of FIG. 1, FIG. 2A being a plan view, FIG. 2B a partial sectional view when viewed laterally, and FIG. 2C a partial sectional view taken along lines IIC—IIC of FIG. 2B.
Figure 2B:
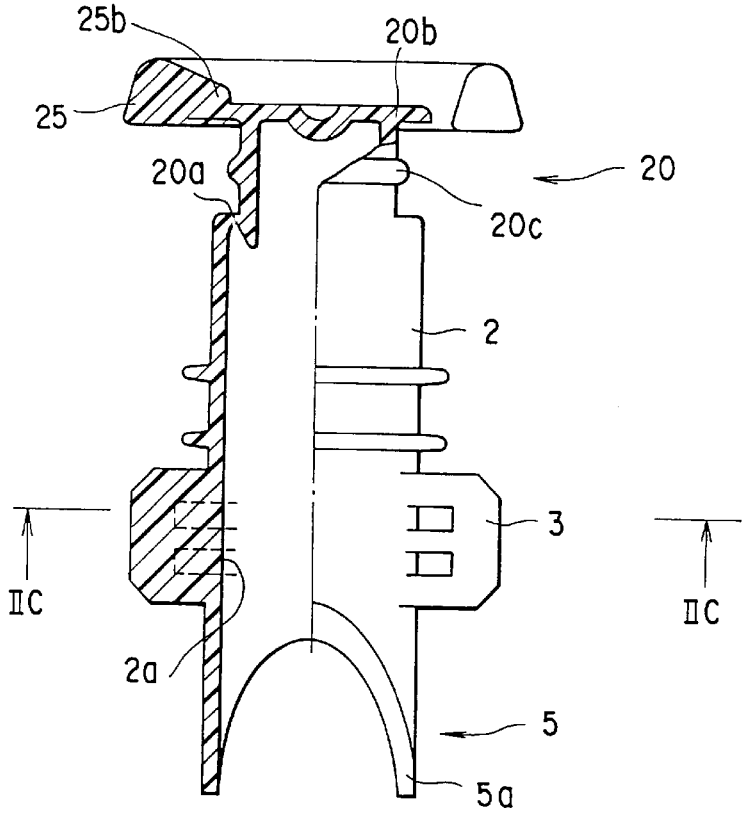
Figure 2C:
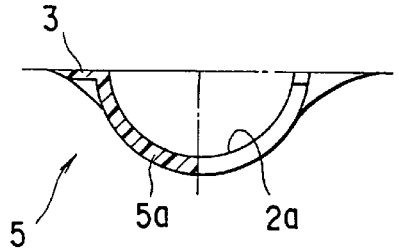
Figure 3A:
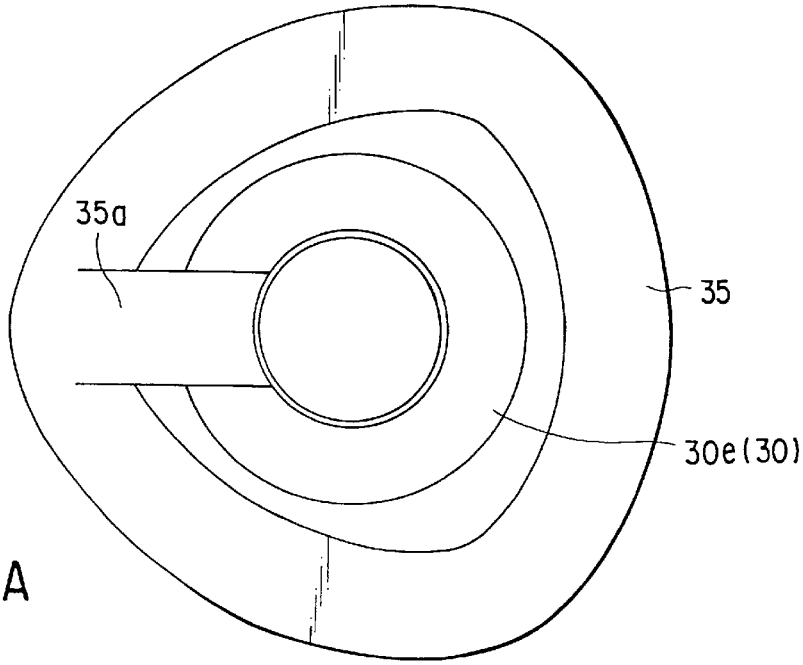
FIGS. 3A–3E show a second embodiment of the invention, FIG. 3A being a plan view, FIG. 3B a sectional view showing a closure main body, FIG. 3C a sectional view taken along lines IIIC—IIIC of FIG. 3B, FIG. 3D a view showing a cutout portion, which appears in FIG. 3C, when viewed from the left side, and FIG. 3E a view showing a cutout portion, which appears in FIG. 3C, when viewed from the right side.
Figure 3B:
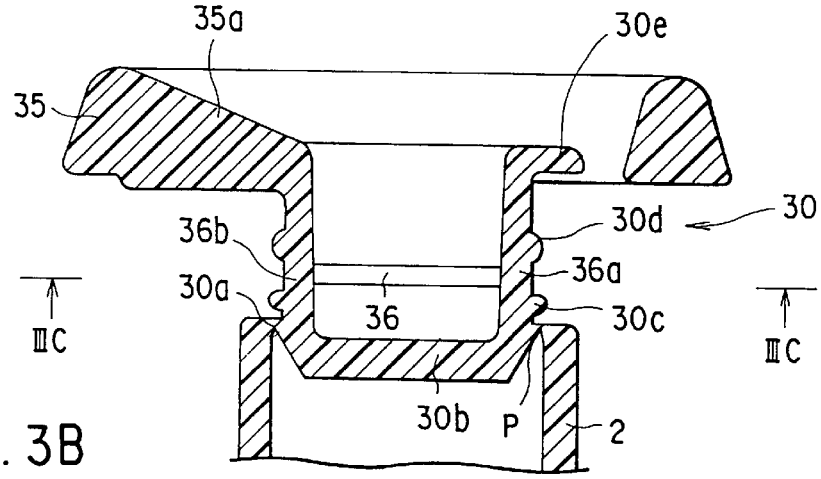
Figure 3D:
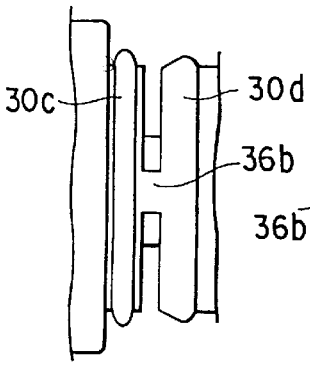
Figure 3C:
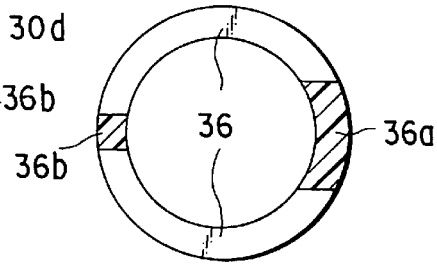
Figure 3E:
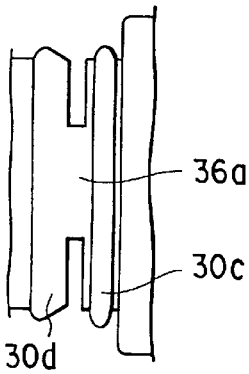
Figure 4A:
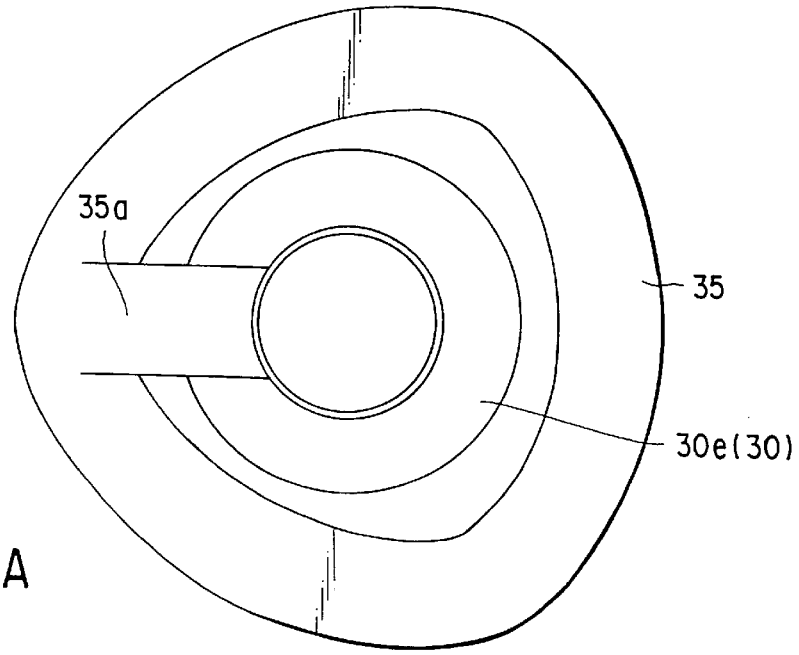
FIGS. 4A–4E show a third embodiment of the invention, FIG. 4A being a plan view, FIG. 4B a sectional view showing a closure main body, FIG. 4C a sectional view taken along lines IVC—IVC of FIG. 4B, FIG. 4D a view showing a cutout portion, which appears in FIG. 4C, when viewed from the left side, and FIG. 4E a view showing a cutout portion, which appears in FIG. 4C, when viewed from the right side.
Figure 4B:
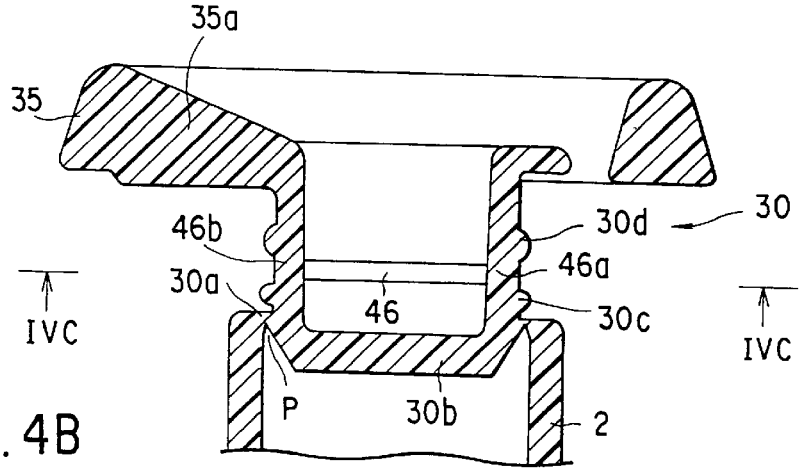
Figure 4D:
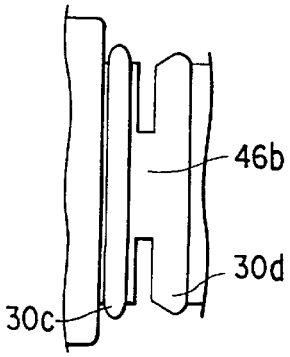
Figure 4C:
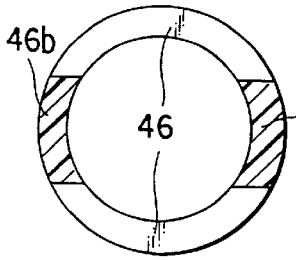
Figure 4E:
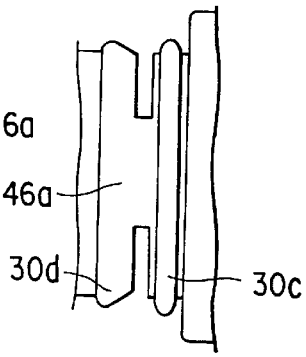

A pinch section 25 is provided at the end of the closure main body 20 opposed to the thin-thickness section. The pinch section 25 is formed so that the thin-thickness section 20*a* can be easily ripped with the pinch section 25 pinched by fingers, thereby easily separating the closure main body 20 from the spout section 2. In the example of FIGS. 2A–2C, the pinch section 25 is ring-shaped and surrounds the closure main body 20 above it, so that it can be easily pinched. The ring-shaped pinch section 25 and the closure main body 20 are coupled with each other by means of coupling sections 25*a*, 25*a* and 25*b* which are provided at regular circumferential intervals. To facilitate the actual ripping operation, the coupling sections 25*a* have a narrow width so that they can be easily cut, while the coupling section 25*b* has a wide width so that it cannot be cut. By virtue of this structure, during the actual use, the coupling sections 25*a* are cut out, and the ripping operation is performed using the fingers, with the pinch section 25 pinched by the fingers.

After being ripped from the spout section 2 at the thin-thickness section 20*a* as a result of pinching the pinch section 25, the closure main body 20 is fitted into the spout section 2, which enables re-sealing of the container. A sealing projection (flange) 20*c*, which can tightly contact the inner periphery of the spout section 2 where the closure main body is fitted in the spout section 2, is provided on the outer periphery of the closure main body 20. In other words, when the closure main body 20 has been dropped into the spout section 2, the projection 20*c* is brought into tight contact with the inner periphery of the spout section 2, thereby preventing leakage of the contents together with the sealing wall 20*b* of the closure main body 20.

Although the structure shown in FIG. 2B has a single projection 20*c*, more reliable sealing is achieved if a plurality of projections are provided axially, as in another embodiment which will be described later. Further, although in the structure, the sealing wall 20*b* is formed on the top-side of the closure main body 20, it may be formed on the lower-end side of the closure main body 20 lower than the thin-thickness section 20*a*. That is, no limitation is given to the position of the sealing wall.

Other embodiments of the invention will be described. In the embodiments described below, only sections different from those of the first embodiment will be described.

FIGS. 3A–3E show a second embodiment of the invention.

A closure main body 30 according to this embodiment is formed of a cylindrical member which has a thin-thickness section 30*a* coupled with the inner periphery of the spout section 2 as in the first embodiment, and also has a sealing wall 30*b* on the main-body side. The sealing wall 30*b* is located lower than the thin-thickness section 30*a* (within the main body). As is indicated by reference numerals 30*c* and 30*d*, two sealing projections are formed at two axial portions of the outer peripheral surface of the closure main body 30 such that they are in tight contact with the inner peripheral surface of the spout section 2.

A pinch section 35 to be used to separate the closure main body 30 from the spout section 2 is coupled, via a coupling section 35*a*, to a brim section 30*e* provided at the upper end of the closure main body 30. The pinch section 35 is shaped like a substantially triangular ring. Thus coupling the pinch section 35 to the closure main body 30 by the single coupling section 35*a* of a wide width enables easy pinching of the pinch section when ripping.

Also in this embodiment, the periphery of the closure main body 30 is partially cut out over predetermined ranges in a direction perpendicular to the direction of communication (the resultant cutouts are indicated by reference numeral 36), and the pinch-side of the closure main body and the thin-thickness side thereof are coupled by means of coupling sections 36*a* and 36*b* which are located circumferentially opposite to each other. The formation of the cutouts and the coupling sections provide the following advantage:

When pinching the pinch section 35 to rip the closure main body, the closure main body and the spout section are coupled to each other by the thin-thickness section through 360°, as described above. Accordingly, to start ripping, it is necessary to apply a force through 360°, which means that a relatively large pinching force is needed. This embodiment is constructed such that the pinching force is concentrically applied to a certain portion of the closure main body to enable the ripping operation with a small amount of force. Specifically, the coupling section 36*b* located below the coupling section 35*a* which couples the pinch section 35 to the closure main body 30 is made to a width narrower than the coupling section 36*a* opposed to the coupling section 36*b*. This being so, the coupling section 36*b* can be easily cut.

The operation performed in the above-described structure to open the closure main body will now be described. First, the pinch section 35 is pinched and raised. The raising force is exerted on the coupling section 35*a*, thereby cutting the coupling section 36*b* located below the coupling section 35*a*. Then, the raising force is concentrated on the coupling section 36*a* and also on a point P of the thin-thickness section 30*a* located below the coupling section 36*a*. As a result, the thin-thickness section 30*a* starts to be ripped from the point P, thereby ripping the overall thin-thickness section. Thus, ripping or separation can be performed easily.

The thus-separated closure main body 30 is again dropped into the spout section 2, thereby re-sealing the container using the sealing wall 30*b* and the projections 30*c* and 30*d*. Even if the projection 30*d* is not formed in this embodiment, the re-sealing state can be realized.

FIGS. 4A–4E show a third embodiment of the invention. In this embodiment, there are provided two circumferentially symmetrical cutouts 46, and two coupling sections 46*a* and 46*b* of the same width, which width prevents them from being cut. In this structure, the force to open the closure is concentrated on the coupling section 46*b* and hence on a point P of the thin-thickness section 30*a* located below the coupling section 46*b*, thereby ripping the thin-thickness section 30*a* from the point P. As a result, the closure main body 30 can be easily separated along the entire thin-thickness section 30*a*.

Moreover, since the coupling section 46*b* is not cut, the closure main body 30 is prevented from becoming hinged even after the separation, which means that the shape of the closure main body can be kept unchanged when re-sealing the container, and hence the container can be sealed in a reliable manner.

As described above, the shapes, positions or number of coupling sections provided by forming cutouts can be modified depending upon the manner of use. Naturally, the projection 30*d* may not be formed as in the second embodiment.

Further, as described above, the closure to be attached to the container has a one-piece structure in which the spout section and the closure main body are connected to each other at the thin-thickness section. Accordingly, a closure of a simple structure can be made at a low cost. Moreover, since the closure is constructed such that the closure main body is fitted in the spout section to thereby re-seal the container, leakage or dripping of liquid can be effectively prevented when performing the re-sealing operation.

Figure 5:
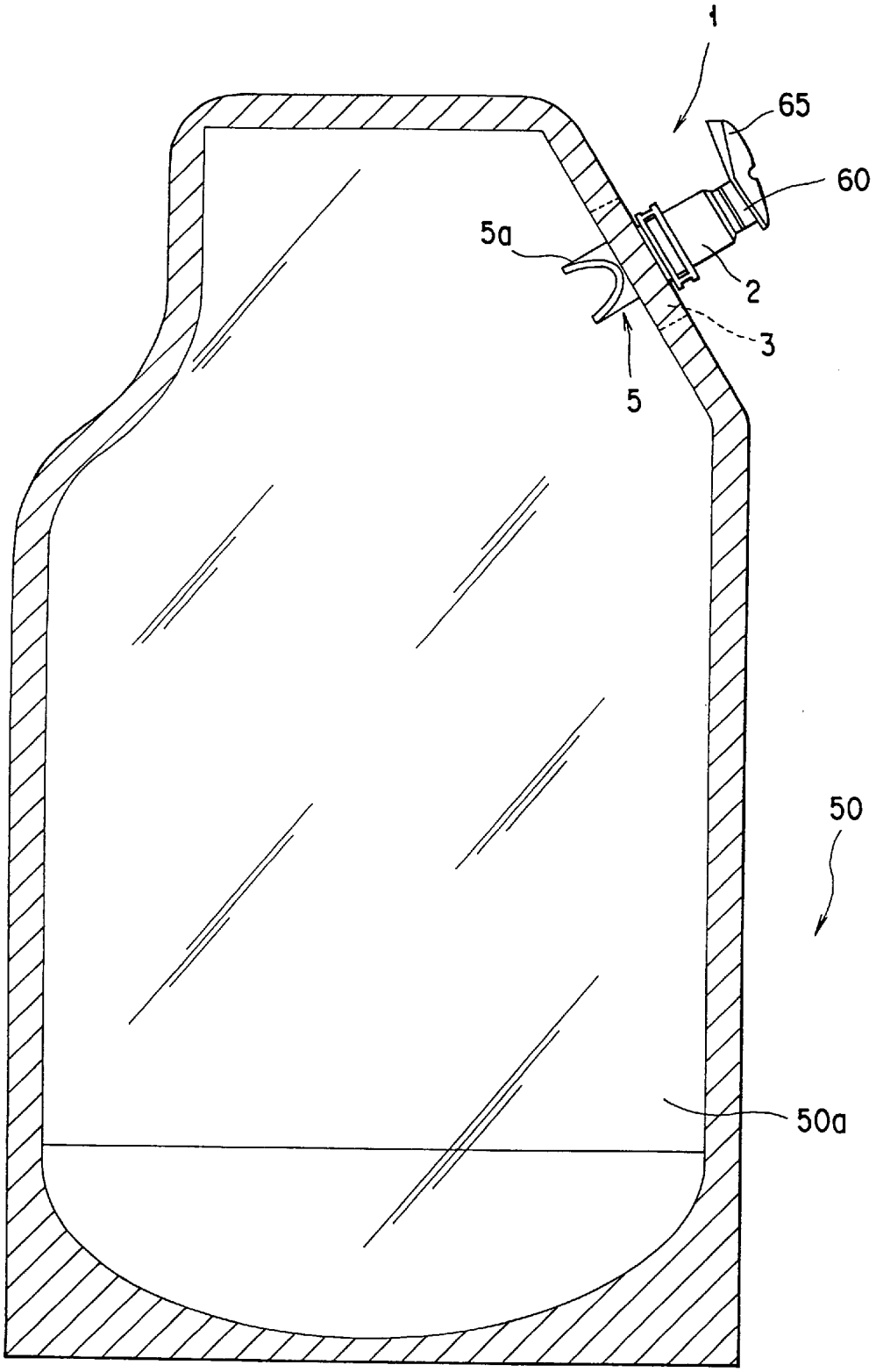
FIG. 5 is a view of a closure according to a fourth embodiment of the invention, showing a state in which the closure is attached to a container formed of synthetic resin sheets.

FIG. 5–FIG. 7E show a fourth embodiment of the invention. As is shown in FIG. 5, a closure 1 is attached to a container 50 as in the first embodiment.

Figure 6:
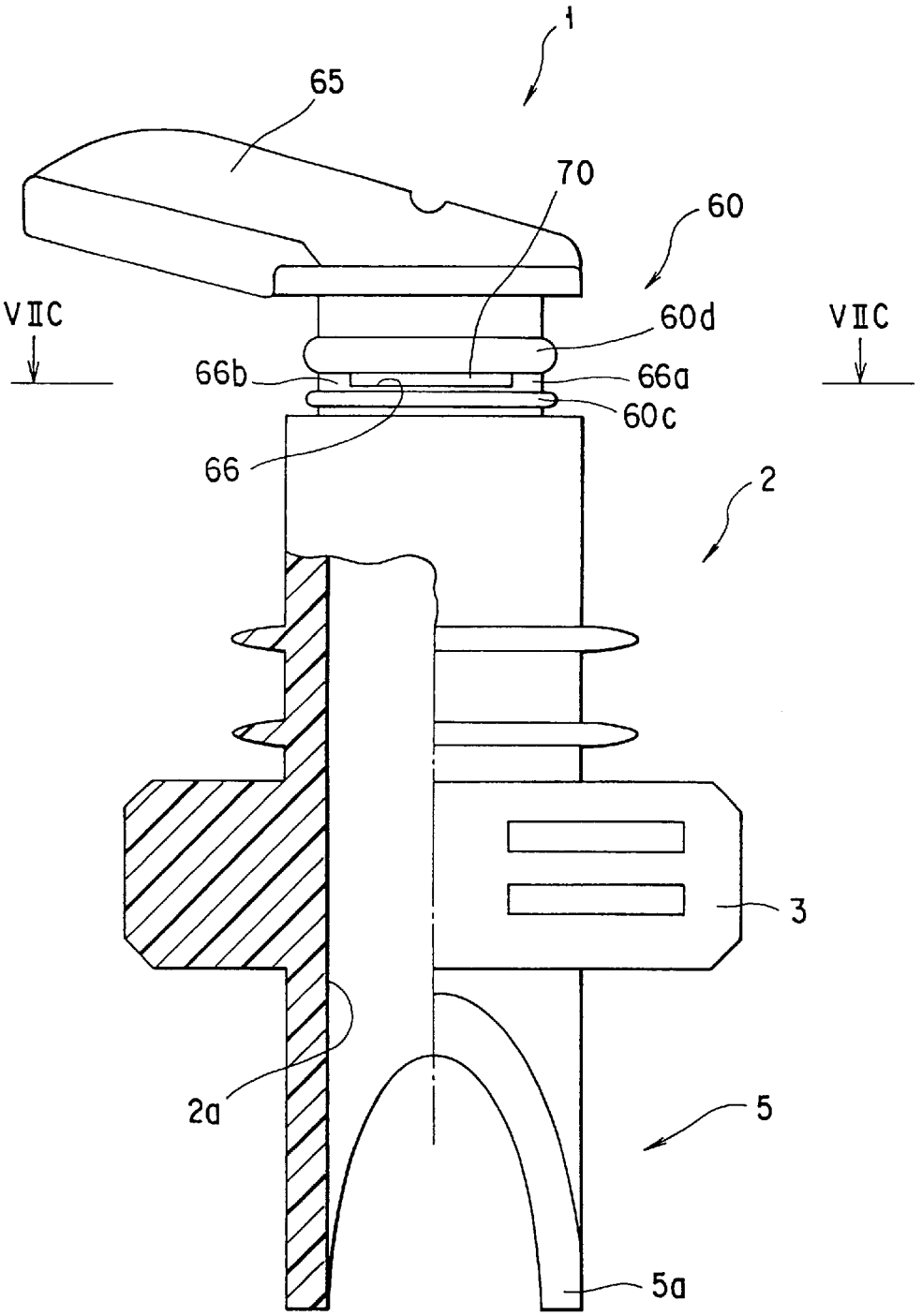
FIG. 6 is an enlarged partially broken view showing the closure of FIG. 5.

A closure main body 60 has a pinch section 65 at an end opposite to a thin-thickness section 60*a* thereof. The pinch section 65 is to be pinched by the fingers to thereby rip the closure main body 60 at the thin-thickness section 60*a* and separate it from the spout section 2. As is shown in FIG. 6, the pinch section 65 is shaped like a tongue which projects in one direction above the closure main body 60 to facilitate its handling. The direction of projection of the pinch section (tongue section) 65 is set parallel to a rib provided between coupling sections, which will be described later.

After being ripped from the spout section 2 at the thin-thickness section 60*a* as a result of pinching the pinch section 65, the closure main body 60 is fitted in the spout section 2, which enables re-sealing of the container. A sealing wall 60*b* is formed below the thin-thickness section 60*a*, and sealing projections (flanges) 60*c* and 60*d*, which can tightly contact the inner periphery of the spout section 2 where the closure main body is fitted in the spout section, are provided on the outer periphery of the closure main body 60 with a predetermined axial space interposed therebetween. In other words, when the closure main body 60 has been dropped into the spout section 2, the projections 60*c* and 60*d* are brought into tight contact with the inner periphery of the spout section 2, thereby preventing leakage of the contents, together with the sealing wall 60*b* of the closure main body 60.

The periphery of the closure main body 60 is partially cut out between the projections 60*c* and 60*d* over predetermined ranges in a direction perpendicular to the direction of communication, thereby forming cutouts 66. In this embodiment, the cutouts 66 circumferentially extend through substantially 180° and are opposed to each other, with the result that the pinch section side of the closure main body and the thin-thickness section thereof are coupled by means of two diametrically opposed coupling sections 66*a* and 66*b* of the same width. Forming the cutouts 66 as above provides the following advantage:

When pinching the pinch section 65 to rip the closure main body, the closure main body 60 and the spout section 2 are coupled to each other by the thin-thickness section 60*a* through 360°, as described above. Accordingly, to start ripping, it is necessary to apply a force through 360°, which means that a relatively large pinching force is needed. This embodiment is constructed such that the pinching force is concentrically applied to a certain portion of the closure main body to enable the ripping operation with a small amount of force.

As described above, where the cutouts 66 are formed in the closure main body 66, the force occurring during ripping is concentrated on the coupling sections 66*a* and 66*b*, and in particular, the tensile force of the ripping operation is concentrated on the coupling section 66*b*. As a result, the force is concentrically exerted on the point P of the thin-thickness section 60*a* located below the coupling section 66*b*, which enables extremely easy ripping of the thin-thickness section 60*a* from the point P.

Figure 7A:
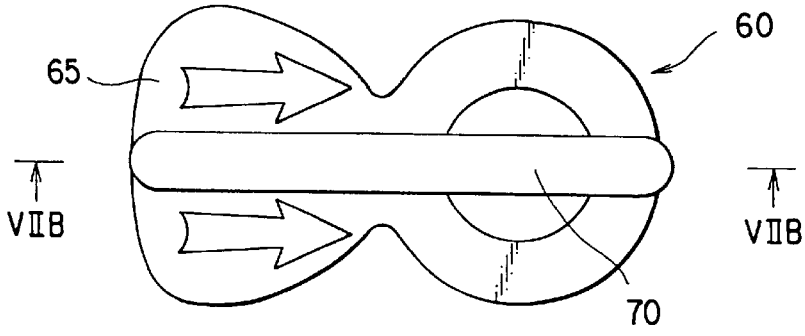
FIGS. 7A–7E show the closure of FIG. 5, FIG. 7A being a plan view, FIG. 7B a sectional view taken along lines VIIB—VIIB of FIG. 7A, FIG. 7C a sectional view taken along lines VIIC—VIIC of FIG. 6, FIG. 7D a view showing a cutout portion, which appears in FIG. 7C, when viewed from the left side, and FIG. 7E a view showing a cutout portion, which appears in FIG. 7C, when viewed from the right side.
Figure 7B:
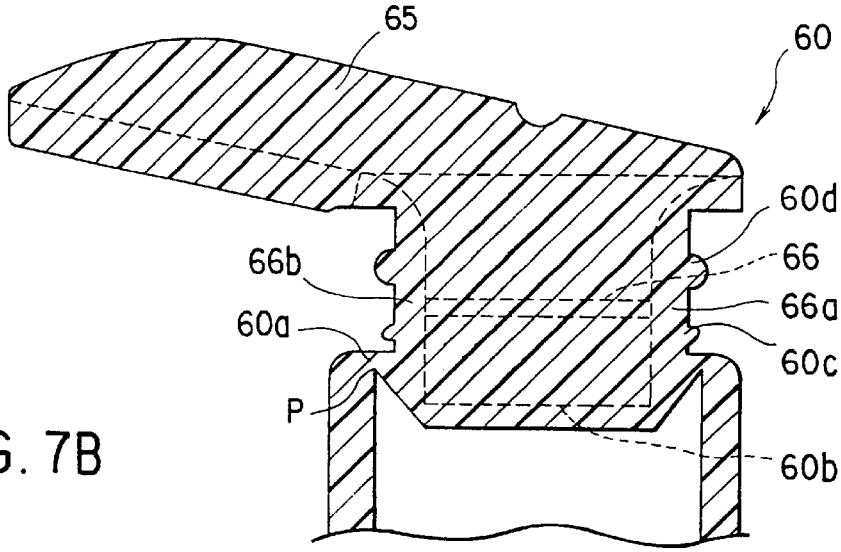
Figure 7D:
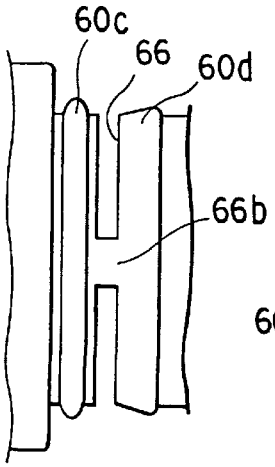
Figure 7C:
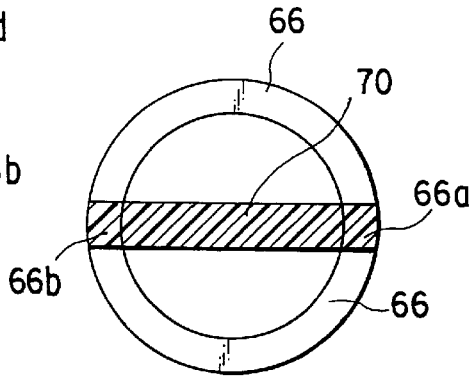
Figure 7E:
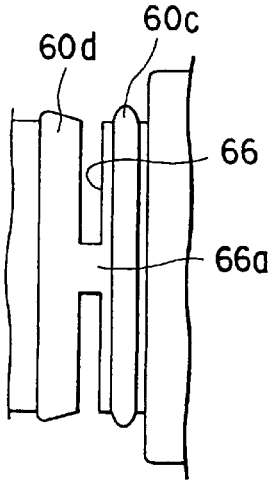

It is preferable that the positions of the coupling sections and the structure of the pinch section 65 should be determined to enable most efficient concentration of force. Specifically, where the pinch section 65 is shaped like a tongue which projects in one direction above the closure main body 60 as shown in FIG. 7A, to rip the closure main body, the user will grasp an end (an adjusting section 5) of the spout section 2 with one hand, and pinch the pinch section 65 with the fingers of the other hand, thereby pulling the pinch section 65 in a direction indicated by the arrows. In light of this, it is efficient to form the cutouts 66 such that the coupling sections 66*a* and 66*b* are arranged in the pulling direction (i.e. the projecting direction of the pinch section 65).

Moreover, a rib is provided on the inner peripheral surface of the closure main body 60 so that the force which can be exerted in any direction depending upon the ripping operation will be efficiently concentrated, and also so that neither the closure main body 60 will be deformed nor the generated force will be dispersed when the ripping operation is performed. To this end, it is preferable in the above structure that the rib should be extended between the coupling sections 66*a* and 66*b* as indicated by reference numeral 70 in FIG. 7C. The rib 70 enables efficient transmission of force during ripping, and hence the closure main body 60 can be easily ripped by a relatively weak force. Further, even when the force from the pinch section 65 does not act in the direction indicated by the arrows, the rib 70 enables concentration of the force on the coupling sections 66*a* and 66*b*. The rib 70 can also reinforce the closure main body 60, and therefore the closure main body can be prevented from being deformed during ripping. As a result, the closure main body can be more easily and reliably separated from the spout section.

Figure 8:
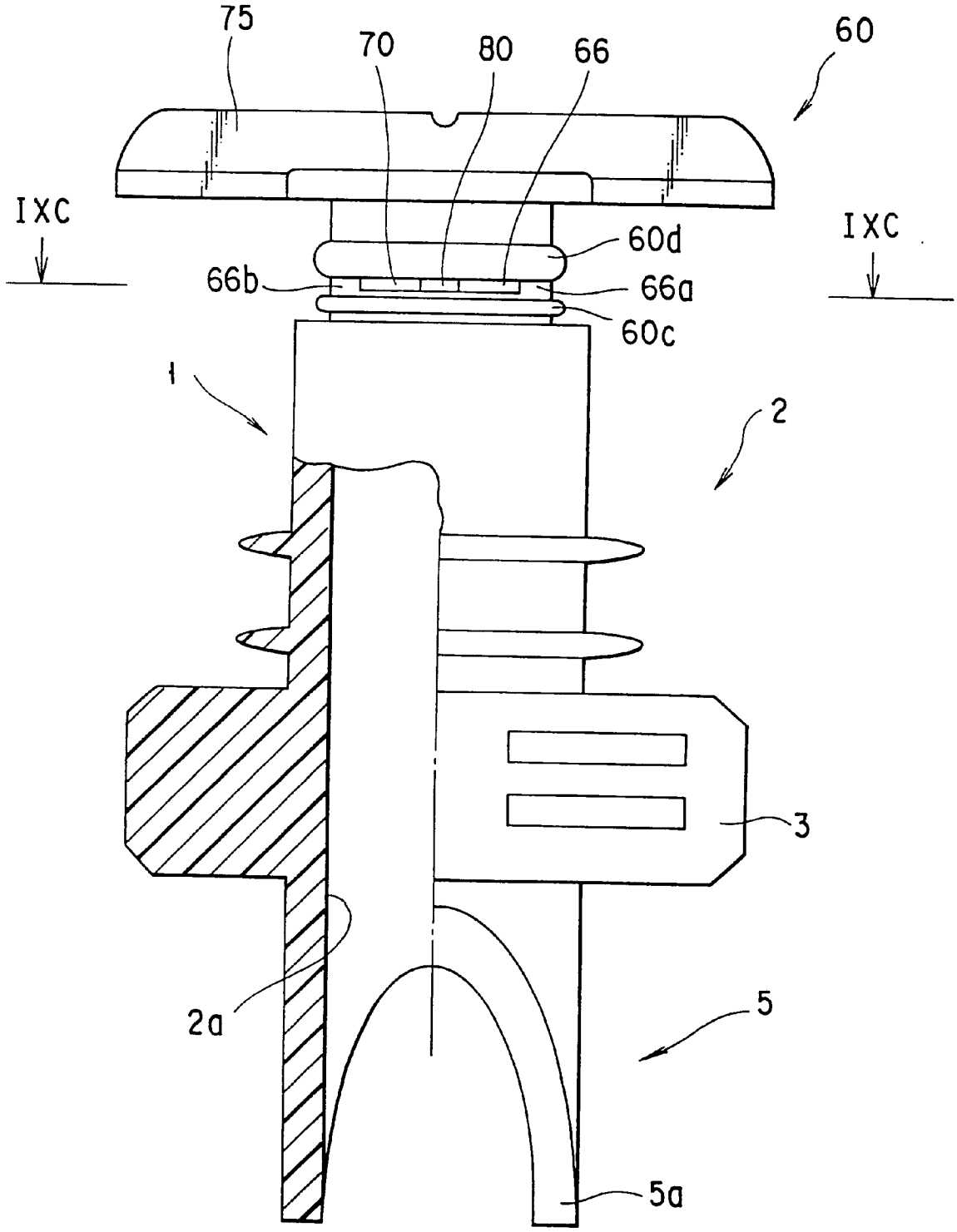
FIG. 8 is an enlarged partially broken view showing a closure according to a fifth embodiment of the invention.
Figure 9A:
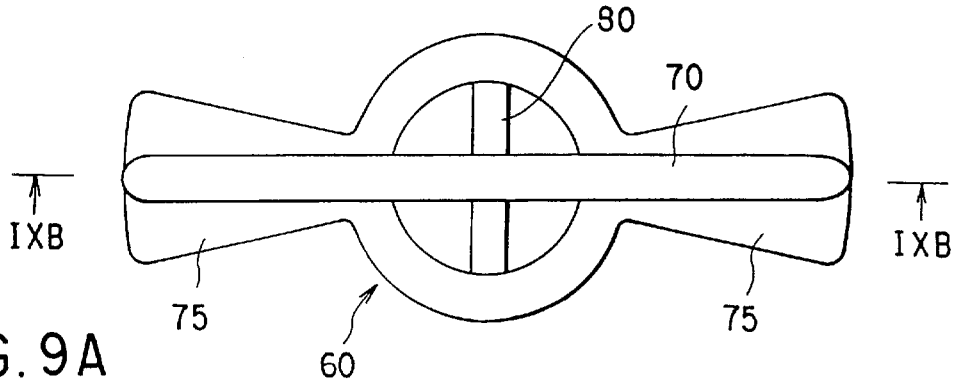
FIGS. 9A–9E show the closure of FIG. 8, FIG. 9A being a plan view, FIG. 9B a sectional view taken along lines IXB—IXB of FIG. 9A, FIG. 9C a sectional view taken along lines IXC—IXC of FIG. 8, FIG. 9D a view showing a cutout portion, which appears in FIG. 9C, when viewed from the left side, and FIG. 9E a view showing a cutout portion, which appears in FIG. 9C, when viewed from the right side.
Figure 9B:
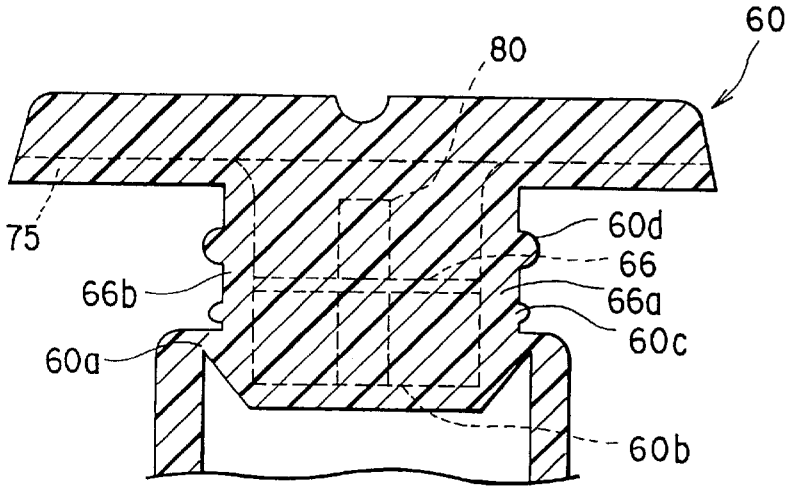
Figure 9D:
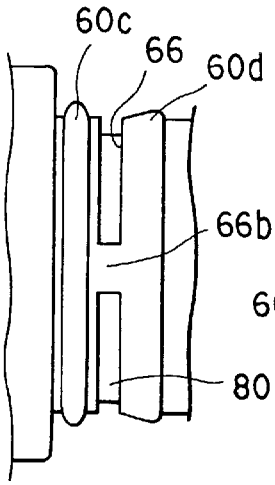
Figure 9C:
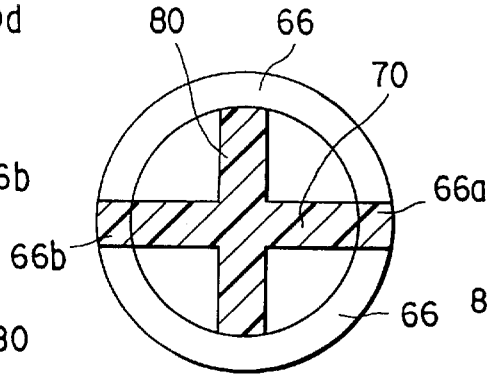
Figure 9E:
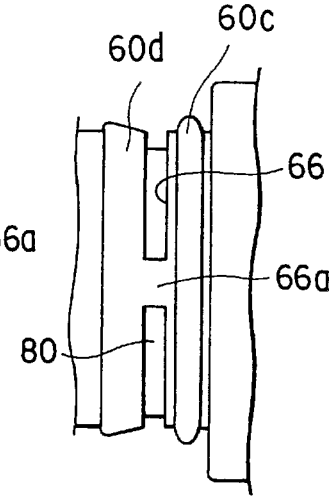

FIGS. 8–9E show a fifth embodiment of the invention. In this embodiment, a pinch section incorporated in the closure main body 60 consists of two tongue sections 75, 75 which diametrically project from the outer periphery of the closure main body 60. The same rib 70 as in the fourth embodiment is provided on the inner surface of the cylindrical closure main body 60 such that it is parallel to the projecting direction of the tongue sections 75. Another rib 80 is provided on the inner surface of the closure main body 60 perpendicular to the rib 70.

The structure in which the rib 80 is provided perpendicularly in addition to the rib 70 efficiently reinforces the closure main body 60, thereby preventing deformation of the closure main body 60 when opening the closure. Where in particular, the pinch sections (tongue sections) 75 are shaped as shown in those figures, it is possible that the user will twist the tongue sections 75. Even when the tongue sections are twisted, breakage of the coupling sections 66*a* and 66*b* due to deformation of the closure will not occur since the entire closure main body 60 is effectively reinforced by the ribs 70 and 80. The rib structure (the shape, thickness or position of each rib, the number of ribs, etc.) employed in the closure main body 60 can be modified in various manners, depending upon the shape of the pinch section and how the force is exerted thereon. Also, the ribs may be formed at different levels, depending upon their arrangement direction. In the FIG. 9B case, for example, the rib 80 is at a level lower than the rib 70. However, to obtain a sufficient reinforcing effect, it is preferable that the upper end of each rib should be at a level higher than the cutouts 66.

Figure 10A:
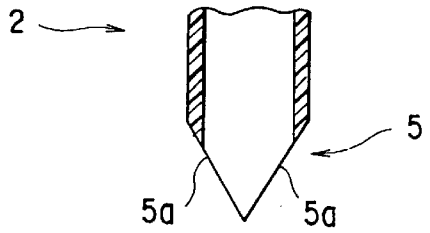
FIG. 10A is a view showing a flow adjusting mechanism formed at a spout section projecting into a container, and FIG. 10B a view showing a modification of the flow adjusting mechanism.
Figure 10B:
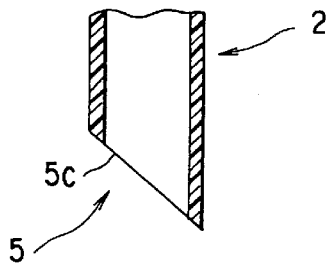

Further, concerning the spout section 2 of the closure 1 constructed as above, it is preferable that the projection of the spout section 2 within the container should be set short (specifically, as short as permits pinching of it), so that the contents can easily flow therethrough when the container 50 is inclined. It is also preferable that an adjusting section 5 for adjusting the flow of the contents is provided at the projection end of the spout section. Specifically, as shown in FIG. 10A, the projection end of the spout section 2 has two inclined portions 5*a* which are gradually separated from inner surface of the sheet member of the container from near the fused portion to the tip of the section 2 within the container. When the portion of the sheet member which is close to the projection of the spout section 2 has been pinched from outside, inner surface portions of the sheet member are brought into contact with the inclined sides 5*a* to thereby seal the opening of the spout section 2. This being so, the flow of the contents can be controlled by pinching the projection of the spout section 2 while inclining the container 50, and adjusting the pinching force. Accordingly, dripping of the contents due to overflowing can be avoided when, for example, the contents of the container are shifted into another container. The shape of the projection end of the spout section 2 is not limited to the inclined one, but may be modified in various manners. It suffices if the projection end can control the flow rate. For example, the projection end may have a single inclined portion 5*c* as shown in FIG. 10B. Moreover, any structure other than that which includes an inclined portion may be employed. It suffices if the opening of the spout section 2 can be sealed.

Figure 11A:
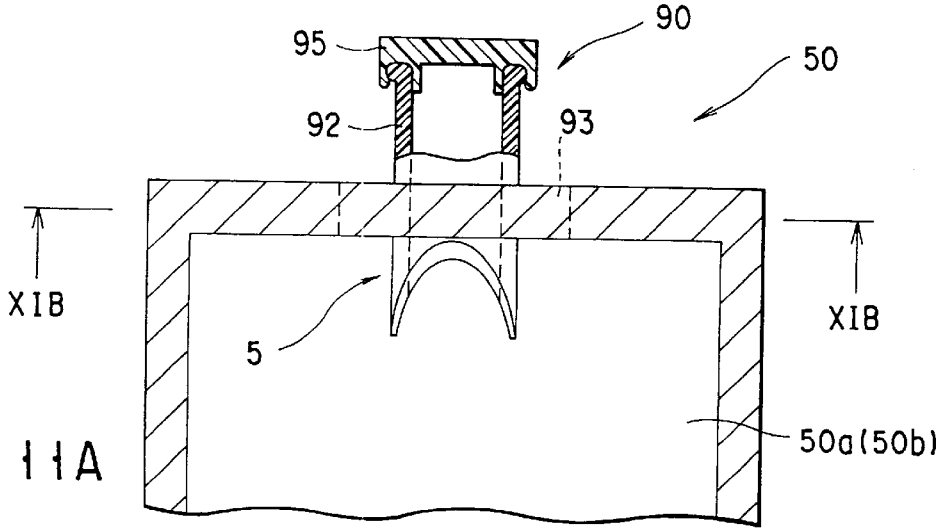
FIG. 11A shows another example of the container with the flow adjusting mechanism, FIG. 11B being a sectional view taken along lines XIB—XIB of FIG. 11A, FIG. 11C a sectional view showing another example of the spout section.
Figure 11B:
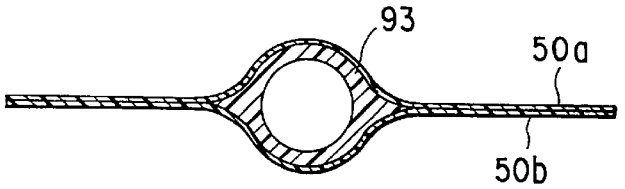
Figure 11C:
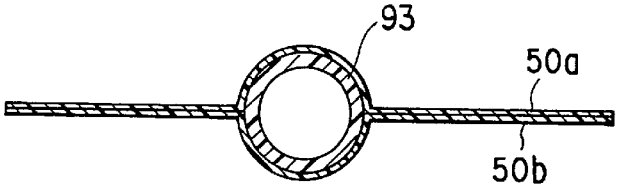

Application of the aforementioned flow adjusting mechanism is not limited to the above-described closure, but also to a closure as shown in FIGS. 11A–11C. In this case, a closure 90 to be attached to the container 50 includes a spout section 92 which projects within the container for passing the contents therethrough, and a to-be-fused section 93 of a substantially elliptic or circular section as shown in FIG. 11B or 11C. An adjusting section 5 for adjusting the flow of the contents as described above is formed at the projection end of the spout section 92. The other end of the spout section 92 is constructed to be covered with a cap 95. Thus, the adjusting section 5 is applicable to various types of closures.

The invention is not limited to the above-described embodiments, but may be modified in various manners. For example, the closure of the invention can be attached to a plastic bottle, as well as containers made of synthetic resin sheets shown in FIGS. 1 and 5. In addition, the section or length of each of the spout section and the closure main body, the tip configuration of the spout section, the structure of the pinch section, etc. can be modified in various manners.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A closure to be attached to a container, comprising:

a spout section through which contents of the container pass;

a closure main body connected to the spout section with a thin-thickness connecting section interposed therebetween, the closure main body having a projection to be fitted into the spout section such that it tightly contacts an inner peripheral surface portion of the spout section, and a sealing wall for preventing leakage of the contents;

a pinch section formed as a part of the closure main body; and said closure main body having a generally hollow, annular connection section provided by a peripheral wall located between the pinch section and thin-thickness section, circumferentially opposed portions of the peripheral wall being removed to form cutouts defining coupling sections above the thin-thickness section, said coupling sections cooperating with the pinch section to facilitate ripping of the thin-thickness section to separate the closure main body from the spout section.

2. A closure according to claim 1, wherein the coupling sections are opposed to each other, and have different widths.

3. A closure according to claim 2, wherein a coupled portion of the pinch section and the closure main body is located above that one of the coupling sections which has a narrower width.

4. A closure according to claim 1, wherein the coupling sections are opposed to each other, and have the same width.

5. A closure according to claim 4, wherein the coupled portion of the pinch section and the closure main body is located above at least one of the coupling sections.

6. A closure according to claim 1, wherein the pinch section is ring-shaped.

7. A closure according to claim 1, further comprising a rib extending between inner surface portions of the closure main body.

8. A closure according to claim 7, wherein the rib extends between the coupling sections.

9. A closure according to claim 1, further comprising a first rib extending between the coupling sections, and a second rib perpendicular to the first rib.

10. A closure according to claim 8, wherein the pinch section formed as the part of the closure main body extends parallel to the rib which extends between the coupling sections.

11. A closure according to claim 10, wherein the pinch section non-symmetrically projects from the closure main body.

12. A closure according to claim 1, wherein an end portion of the spout section which projects into the container is provided with an adjusting section for adjusting the flow rate of the contents, the adjusting section extending from a closure attachment portion of the container to the end portion of the spout section, and being brought into tight contact with inner surface portions of the container when the container is pressed from the outside, thereby adjusting the flow rate.

13. A closure according to claim 12, wherein the adjusting section has an inclined section, the distance between the inclined section and the inner surface of the container gradually increasing as the inclined section approaches the tip of the spout section.

14. A closure to be attached to a container, comprising:

a spout section through which contents of the container pass;

a closure main body connected to the spout section with a thin-thickness connecting section interposed therebetween, the closure main body having a projection to be fitted into the spout section such that it tightly contacts an inner peripheral surface portion of the spout section, and a sealing wall for preventing leakage of the contents;

a pinch section formed as a part of the closure main body; and said closure main body having a generally hollow, annular connection section provided by a peripheral wall located between the pinch section and thin-thickness section, a portion of the peripheral wall being removed to form at least one cutout defining a coupling section above the thin-thickness section, said coupling section cooperating with the pinch section to facilitate ripping of the thin-thickness section to separate the closure main body from the spout section.

15. A container provided with a closure through which contents thereof is taken out, the closure comprising:

a spout section having an end portion projecting in the container for passing the contents therethrough; and an attachment section formed at the spout section and attached to the container, wherein the spout section is provided with an adjusting section for adjusting the flow rate of the contents, the adjusting section extending from the attachment section to the end portion of the spout section, and being brought into tight contact with inner surface portions of the container when the container is pressed from the outside, thereby adjusting the flow rate, the adjusting section having an inclined section, the distance between the inclined section and the inner surface of the container gradually increasing as the inclined section approaches the end portion of the spout section.

* * * * *